US009104163B2

(12) United States Patent
Serizawa

(10) Patent No.: US 9,104,163 B2
(45) Date of Patent: Aug. 11, 2015

(54) IMAGE FORMING APPARATUS AND POST-PROCESSING APPARATUS

(71) Applicant: CANON KABUSHIKI KAISHA, Tokyo (JP)

(72) Inventor: Masahiro Serizawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/087,556

(22) Filed: Nov. 22, 2013

(65) Prior Publication Data

US 2014/0153992 A1 Jun. 5, 2014

(30) Foreign Application Priority Data

Nov. 30, 2012 (JP) ..... 2012-262316

(51) Int. Cl.

| | |
|---|---|
| ***B31F 1/07*** | (2006.01) |
| ***G03G 15/00*** | (2006.01) |
| ***B31F 5/02*** | (2006.01) |
| ***B42F 3/00*** | (2006.01) |

(52) U.S. Cl.

CPC ..... *G03G 15/6544* (2013.01); *B31F 1/07* (2013.01); *B31F 5/02* (2013.01); *B42F 3/003* (2013.01); *G03G 15/6582* (2013.01); *B31F 2201/00* (2013.01); *B65H 2301/51616* (2013.01); *G03G 2215/00852* (2013.01)

(58) Field of Classification Search

CPC ..... G03G 15/6582; G03G 2215/00852; B31F 5/02; B31F 1/07; B31F 2201/00; B65H 2301/51616; B42F 3/003

USPC ..... 270/58.07, 58.08; 399/408, 410

See application file for complete search history.

(56) References Cited

U.S. PATENT DOCUMENTS

| | | | | |
|---|---|---|---|---|
| 5,774,778 | A * | 6/1998 | Adachi et al. | 399/403 |
| 7,537,205 | B2 * | 5/2009 | Nagata et al. | 270/58.09 |
| 7,982,888 | B2 | 7/2011 | Yamada et al. | |
| 8,282,091 | B2 * | 10/2012 | Furuhashi et al. | 270/45 |
| 8,413,979 | B2 * | 4/2013 | Sato | 270/58.08 |
| 8,430,389 | B2 * | 4/2013 | Tokuma et al. | 270/37 |
| 2013/0214472 | A1 * | 8/2013 | Suzuki | 270/1.01 |
| 2014/0001693 | A1 * | 1/2014 | Ishizuka | 270/1.01 |

FOREIGN PATENT DOCUMENTS

| | | | |
|---|---|---|---|
| JP | 9-151024 | A | 6/1997 |
| JP | 3885410 | B2 | 2/2007 |

(Continued)

OTHER PUBLICATIONS

Office Action dated Aug. 5, 2014, in Japanese Patent Application No. 2013-214695.

*Primary Examiner* — Leslie A Nicholson, III

(74) *Attorney, Agent, or Firm* — Fitzpatrick, Cella, Harper & Scinto

(57) ABSTRACT

Provided is an image forming apparatus capable of executing a plurality of kinds of binding process in one job. A printer control section transmits, to a finisher, a job for equal to or larger than a total number of copies being a sum of a first number of copies for performing the binding process by using a staple and a second number of copies for performing the binding process without use of the staple. On the finisher side, in accordance with the job, a finisher control section causes a stapler to perform a stapling process for the first number of copies and an eco-stapler to perform an eco-stapling process for the second number of copies.

6 Claims, 15 Drawing Sheets

(56) References Cited

FOREIGN PATENT DOCUMENTS

| | | | |
|---|---|---|---|
| JP | 2007-265388 | A | 10/2007 |
| JP | 2010-184769 | A | 8/2010 |
| JP | 2010-274623 | A | 12/2010 |

* cited by examiner

IMAGE FORMING APPARATUS AND POST-PROCESSING APPARATUS

BACKGROUND OF THE INVENTION

1. Field of the Invention

The present invention relates to an image forming apparatus and a post-processing apparatus. The image forming apparatus and the post-processing apparatus configured to an image forming system. The post-processing apparatus is provided to the image forming system such as a copier or a multifunction peripheral, and is configured to perform a post-process for a sheet material stack obtained by laying a plurality of sheet materials such as paper, on which an image is formed, one on top of another.

2. Description of the Related Art

As one of post-processes for a sheet material on which an image has been formed, there is a process for binding a sheet material stack obtained by laying a plurality of sheet materials one on top of another. The binding process is performed by a binding processing unit (binding mechanism). The binding processing unit is provided to an image forming system. Examples of the binding processing unit include adhesive application using an adhesive, a stapling process or a pinning process using a metal staple, and a process for stapling without use of a binding fastener such as a staple (hereinafter referred to as "eco-stapling"). Note that, a stapler for performing the eco-stapling process is hereinafter referred to as "eco-stapler".

As a related art to the image forming system including such a binding processing unit, there is known an image forming system disclosed in Japanese Patent No. 3885410. In this image forming system, one kind is selected from a plurality of kinds of binding processing unit. Specifically, the image forming system disclosed in Japanese Patent No. 3885410 allows one optimal binding process to be selected based on the number of sheets of the sheet material stack, the kind of sheet of the sheet material stack, or a thickness of the sheet material stack.

In recent years, against the backdrop of an increase in environmental awareness, the eco-stapling process without the use of a staple has been performed more often than before. Further, it is demanded in some cases that formal handouts be securely subjected to the stapling process while the eco-stapling process be performed for informal handouts having the same contents for internal use.

In the image forming system disclosed in Japanese Patent No. 3885410, it is possible to perform a plurality of kinds of binding process. However, only one kind of binding process can be selected for one job. Therefore, to execute both the stapling process and the eco-stapling process for a plurality of sheet material stacks having the same contents, it is necessary to divide the job into, for example, a job for the stapling process and a job for the eco-stapling process. In this case, a user needs to set different binding processes for the respective jobs, which leads to a problem in that usability and operability are not excellent.

SUMMARY OF THE INVENTION

In order to solve the above-mentioned problem, according to one embodiment of the present invention, there is provided an image forming apparatus including: an image forming section configured to form an image on a sheet based on an image forming job; a conveying mechanism configured to convey the sheet to a post-processing apparatus configured to perform a binding process for the sheet on which the image is formed; an operation section configured to receive an input of information on a number of copies to be processed in a case where image formation for a plurality of copies are performed in one image forming job, the information serving to identify a first number of copies being a number of the sheet bundles to be subjected to a first binding process by using a binding fastener in the post-processing apparatus and a second number of copies being a number of the sheet bundles to be subjected to a second binding process different from the first binding process without use of the binding fastener; and a control section configured to cause the post-processing apparatus to perform the first binding process for the first number of copies and the second binding process for the second number of copies based on the information on the number of copies to be processed which is received by the operation section.

Further features of the present invention will become apparent from the following description of exemplary embodiments (with reference to the attached drawings).

DESCRIPTION OF THE EMBODIMENTS

Various exemplary embodiments, features, and aspects of the present disclosure are described below in detail with reference to the drawings.

First Embodiment

Figure 1:
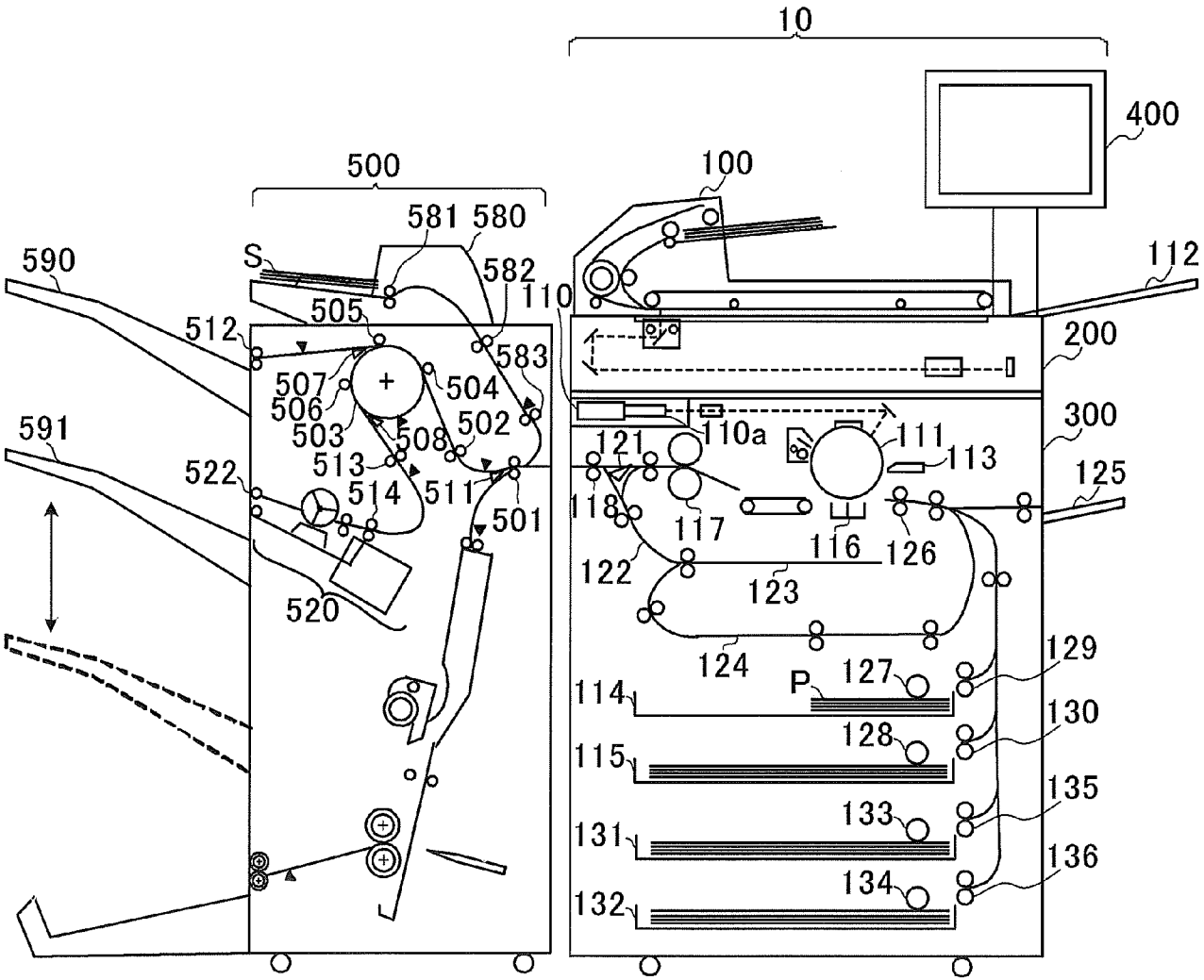
FIG. 1 is a diagram of an overall structure of an image forming system.

FIG. 1 is a diagram of an overall structure of an image forming system according to a first embodiment. The image forming system includes an image forming apparatus 10 for forming an image and a finisher 500 serving as an example of a post-processing apparatus.

The image forming apparatus 10 includes a document feeder 100 for taking in an original, an image reader 200 for reading the original taken in, and a printer 300 for forming the read image of the original (original image) on a paper sheet P serving as an example of a sheet material. The printer 300 and the image reader 200 are connected to each other through a network such as an intra-system communication line. The image reader 200 is connected to the document feeder 100.

(Printer)

The printer 300 roughly includes an image forming mechanism and a conveying mechanism. The image forming mechanism obtains the original image read by the image reader 200 or a print job (image forming job) transmitted from a host computer described later, and forms the image based on the obtained print job. The conveying mechanism conveys the paper sheet P on which the image is to be formed. The image forming mechanism includes an exposure control section 110, a photosensitive drum 111, a developing device 113, a transfer section 116, and a fixing section 117. The conveying mechanism includes pick-up rollers 127, 128, 133, and 134, sheet feeding rollers 129, 130, 135, and 136, registration rollers 126, discharge rollers 118, and a flapper 121. The printer 300 further includes a mechanism for receiving the paper sheet P to supply the conveying mechanism therewith, in other words, cassettes 114, 115, 131, and 132 and a manually sheet feeding section 125. The printer 300 further includes a sheet surface reverse path 122, a double-sided buffer 123, and a duplex conveying path 124 that are used to perform double-sided printing on the paper sheet P.

The exposure control section 110 irradiates the photosensitive drum 111 with a laser beam modulated by the original image read by the image reader 200 or a video signal generated based on the print job while scanning the laser beam by using a polygon mirror 110*a*. Therefore, an electrostatic latent image corresponding to the scanned laser beam is formed on the photosensitive drum 111. The electrostatic latent image is developed with toner supplied from the developing device 113, to be visualized as a toner image representing the original image or the like.

The paper sheet P is fed from any one of the cassettes 114, 115, 131, and 132, the manually sheet feeding section 125, and the duplex conveying path 124 at a timing synchronized with a start of application of the laser beam. The fed paper sheet P is conveyed to a gap between the photosensitive drum 111 and the transfer section 116. Therefore, the toner image on the photosensitive drum 111 is transferred onto the paper sheet P. The paper sheet P onto which the toner image has been transferred is conveyed to the fixing section 117. The paper sheet P is heated and pressurized by the fixing section 117, to thereby have the toner image fixed onto the paper sheet P.

Depending on a state of the flapper 121, the paper sheet P that has passed through the fixing section 117 is discharged from the printer 300 to an external part (finisher 500) via the discharge rollers 118 or conveyed to the sheet surface reverse path 122. In the case of being conveyed to the sheet surface reverse path 122, the paper sheet P is switched back after a trailing edge thereof passes through the flapper 121. Therefore, with an image-formed surface facing down, the paper sheet P is discharged to the external part by the discharge rollers 118.

In a case where double-sided recording for forming images on both sides of the paper sheet P is set, the paper sheet P enters the double-sided buffer 123, and is then switched back with a conveying direction thereof reversed, to thereby convey the paper sheet P to the duplex conveying path 124. The paper sheet P conveyed to the duplex conveying path 124 is controlled to be fed to the gap between the photosensitive drum 111 and the transfer section 116 again at the above-mentioned timing. The paper sheet P output from the printer 300 is sent to the finisher 500 for a post-process.

(Finisher)

The finisher 500 performs the post-process for the paper sheet P discharged from the printer 300. In this embodiment, a description is made of an example of performing, as the post-process, an edge part binding process for a paper sheet stack obtained by laying a plurality of sheets one on top of another, in particular, a stapling process for each predetermined number of paper sheets P serving as a first binding process, and an eco-stapling process (referred to also as "stapleless binding") serving as a second binding process. Note that, depending on a user's setting, no particular binding process may be performed for the paper sheet P before discharging the paper sheet P. A process performed in this case can also be set as the post-process.

The finisher 500 includes conveying rollers 501, 502, 504, 505, 506, 513, and 514, a buffer path roller 503, flappers 507, 508, and 511, discharge rollers 512 and 522, a binding section 520, and trays 590 and 591. The binding section 520 is formed of a post-process-system device group for performing the binding process.

The finisher 500 conveys the paper sheet P along the conveying rollers 501, the flapper 511, the conveying rollers 502 and 504, and the buffer path roller 503 in the stated order. In performing the binding process, the paper sheet P is conveyed to the conveying rollers 513 and 514 via the conveying roller 505, the flapper 507, the conveying roller 506, and the flapper 508, and stocked in the binding section 520 sheet by sheet. When detecting that a whole stack of the paper sheets P which forms one copy has been stocked in the binding section 520, the finisher 500 performs the stapling process or the eco-stapling process therefor, and discharges the stack onto the tray 591 by the discharge rollers 522. The "one copy" is a unit in which the post-process is performed, and means the stack of the paper sheets P having a number of sheets set by the user. In the case where the binding process is not performed, the finisher 500 conveys the paper sheet P along the conveying rollers 501, the flapper 511, the conveying rollers 502 and 504, the buffer path roller 503, the conveying roller 505, and the flapper 507 in the stated order. After that, the paper sheet P is discharged onto the tray 590 by the discharge rollers 512.

Figure 2A:
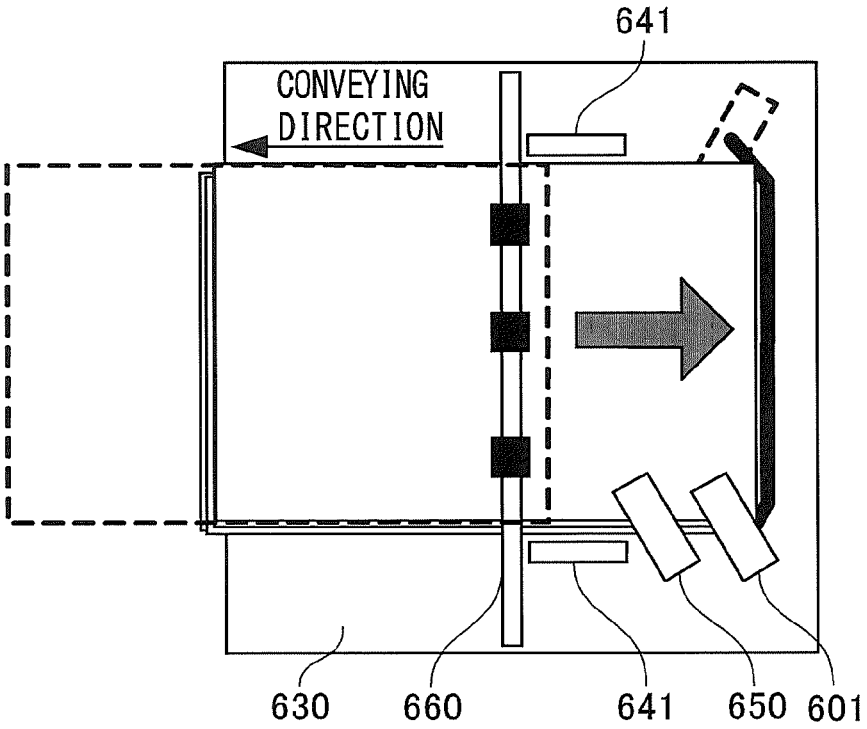
FIG. 2A is a diagram illustrating a paper sheet position used when a binding process is performed.
Figure 2B:
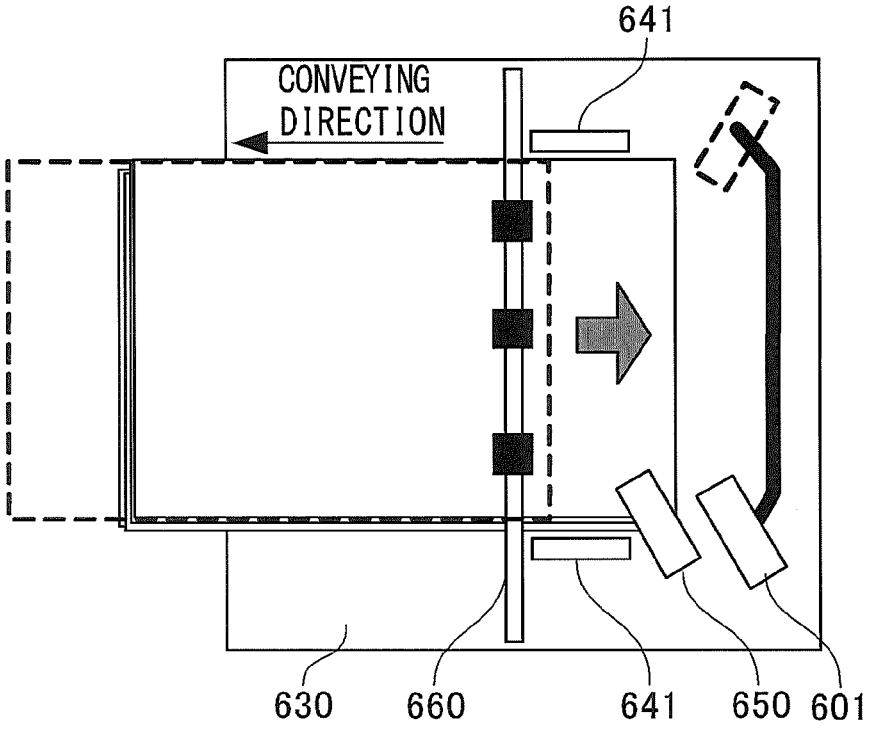
FIG. 2B is a diagram illustrating a paper sheet position used when a binding process is performed.

Here, a description is made of how to handle the paper sheets P in performing the stapling process and the eco-stapling process. FIG. 2A illustrates a paper sheet position used when the stapling process is performed in the binding section 520, and FIG. 2B illustrates a paper sheet position used when the eco-stapling process is performed in the binding section 520. The stapling process is performed by using a stapler 601. The eco-stapling process is performed by using an eco-stapler 650.

A plurality of paper sheets P conveyed to the binding section 520 for the stapling process or the eco-stapling process are discharged onto a processing tray 630 to be stacked thereon. An aligning member 641 performs an aligning process for the plurality of paper sheets P stacked on the processing tray 630 (paper sheet stack). The aligning process relates to, for example, aligning of the paper sheet stack. A paddle 660 pulls back the aligned paper sheet stack in a direction reverse to the conveying direction in the processing tray 630. The paddle 660 pulls back the paper sheet stack to a position illustrated in FIG. 2A to perform the stapling process. On the other hand, the paddle 660 pulls back the paper sheet stack to a position illustrated in FIG. 2B to perform the eco-stapling process. In this manner, the paddle 660 controls a pullback amount depending on a kind of binding process.

The stapler 601 is driven by a stapling motor (not shown) to perform the stapling process, which uses a binding fastener such as a staple, for the paper sheet stack. The stapler 601 performs the stapling process for the paper sheet stack placed on the processing tray 630 at a paper sheet trailing edge in the conveying direction. The stapler 601 is configured to be movable. For example, as illustrated in FIG. 2A, the stapler 601 moves in a direction perpendicular to the conveying direction (in a depth-front direction relative to a front surface of an apparatus) in accordance with the user's setting. When there are no more staples to be used by the stapler 601, a staple presence/absence detecting sensor (not shown) detects that fact.

Figure 3A:
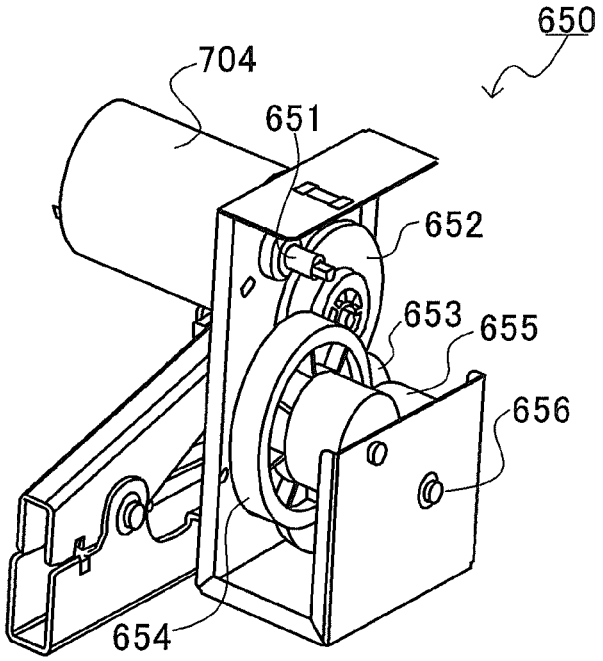
FIG. 3A is a diagram illustrating an eco-stapler.
Figure 3B:
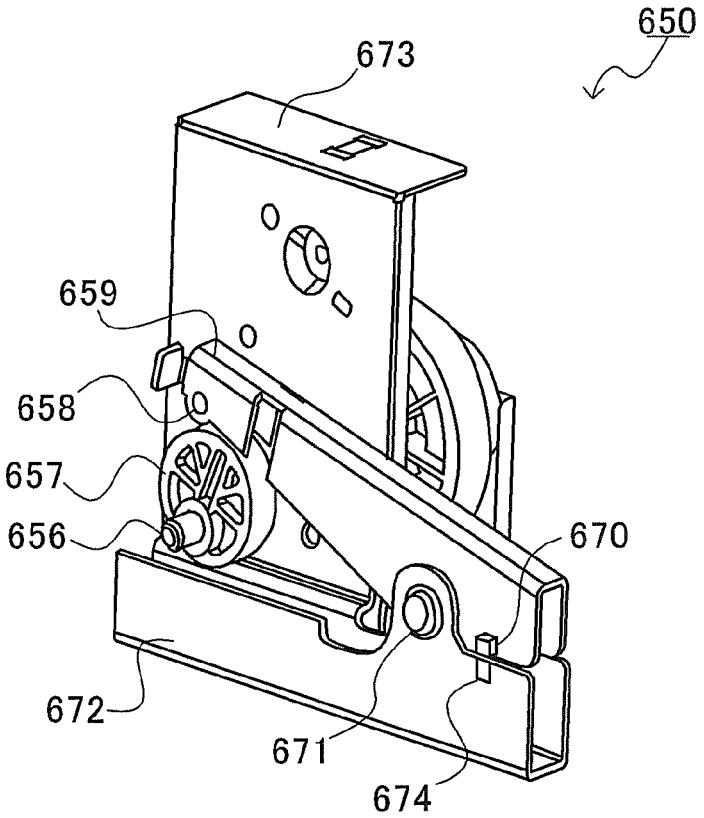
FIG. 3B is a diagram illustrating the eco-stapler.

A detailed description is made of the eco-stapler 650. FIG. 3A and FIG. 3B are diagrams illustrating the eco-stapler 650 from different viewpoints. The eco-stapler 650 includes an eco-stapling motor 704, gears 651 and 655, step gears 652, 653, and 654, a rotation shaft 656, a cam 657, a roller 658, an upper arm 659, upper teeth 670, a shaft 671, a lower arm 672, a frame 673, and lower teeth 674. The rotation of the eco-stapling motor 704 is transmitted to the gear 655 via the gear 651 and the step gears 652 to 654. The gear 655 is mounted to the rotation shaft 656, and hence the rotation shaft 656 is caused to rotate in accordance with the driving of the eco-stapling motor 704.

The rotation shaft 656 given a torque by the eco-stapling motor 704 has the cam 657 mounted thereto. The cam 657 is rotated by the rotation shaft 656 to operate the upper arm 659 via the roller 658. The upper arm 659 has the upper teeth 670 mounted thereto, and swings about the shaft 671. The shaft 671 is supported by the lower arm 672. The lower arm 672 is fixed to the frame 673. As a result, the lower teeth 674 mounted to the lower arm 672 and the upper teeth 670 of the upper arm 659 are engaged with each other in accordance with the driving of the eco-stapling motor 704, to thereby pressurize the paper sheet stack placed in a gap between the lower teeth 674 and the upper teeth 670.

In this pressurizing mechanism, the paper sheet stack is pressed in a pressurizing direction by the upper teeth 670 and the lower teeth 674, to thereby expose fibers on a surface of the paper sheet, and is further pressurized to have the fibers of the neighboring paper sheets entangled with each other, thereby being fastened. Therefore, it is possible to bind the paper sheets together without using staples. Note that, the number of paper sheets that can be subjected to the binding process is smaller than in the stapling process for fastening papers sheets by causing a staple to penetrate therethrough and deforming end portions of the staple after the penetration.

(Control System)

Figure 4:
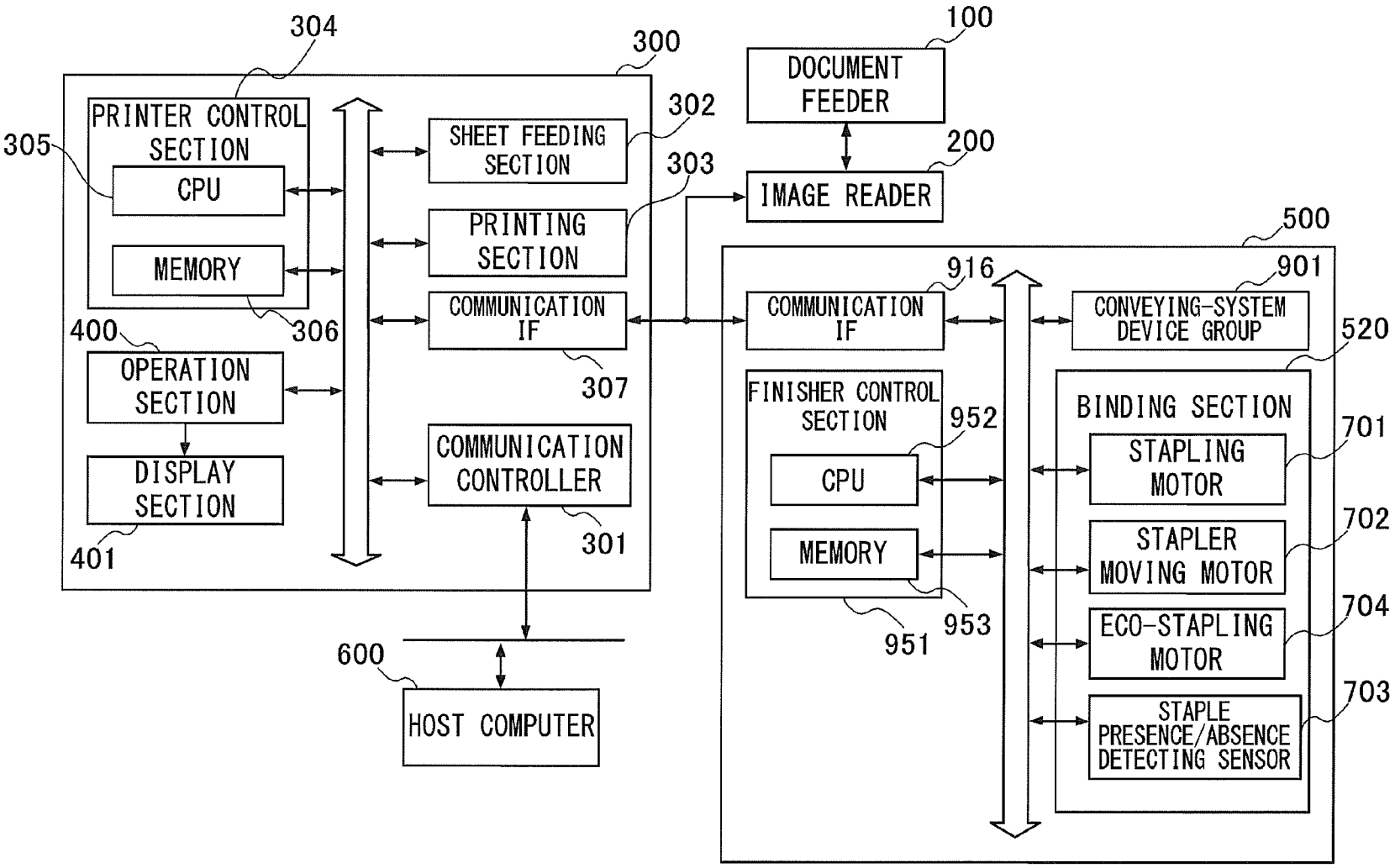
FIG. 4 is a functional configuration diagram of a printer and a finisher.

Next, a description is made of operations of the printer 300 and the finisher 500 performed when the post-process such as the stapling process is performed. FIG. 4 is a diagram illustrating a functional configuration example of the printer 300 and the finisher 500 according to this embodiment.

The printer 300 includes a communication controller 301, a sheet feeding section 302, the printing section 303, a printer control section 304, a communication IF ("IF" is an abbreviation of "interface"; the same applies hereinafter) 307, an operation section 400, and a display section 401. The printer control section 304 is a kind of computer for controlling each section of the printer 300 by a central processing unit (CPU) 305 executing a predetermined program recorded in a memory 306.

The printer 300 is connected to a host computer 600 through a network such as a local area network (LAN). The host computer 600 transmits a print job including a print command and print data to the printer 300. The communication controller 301 receives the print job transmitted from the host computer 600, and transmits contents thereof to the printer control section 304.

The sheet feeding section 302 performs sheet feeding control up to the registration rollers 126 illustrated in FIG. 1. Specifically, in accordance with an instruction issued by the printer control section 304, the sheet feeding section 302 drives the pick-up rollers 127, 128, 133, and 134 and the sheet feeding rollers 129, 130, 135, and 136 illustrated in FIG. 1, to feed the paper sheets P from the cassettes 114, 115, 131, and 132, respectively. The sheet feeding section 302 may feed the paper sheet P from the manually sheet feeding section 125 or the duplex conveying path 124.

The printing section 303 controls conveyance of the paper sheet P after the registration rollers 126. Further, in accordance with the instruction issued by the printer control section 304, the printing section 303 performs printing process based on the print command and the print data for the paper sheet P. A known technology may be used for the printing process.

The communication IF 307 connects between the image reader 200 and the printer 300 or the finisher 500 and the printer 300 through the network such as an intra-system communication line in a mode that allows communications. The mode of communications may be any one of wired communications and wireless communications. By the communications, various commands and information are exchanged between a connection destination and a connection source.

The operation section 400, which is a user interface including a touch panel, receives an instruction for each kind of setting in accordance with the user's operation, and transmits contents of an operation mode of the image forming apparatus 10 including the printer 300 based on the instruction to the printer control section 304. Further, the operation section 400 receives an instruction for each kind of setting to the finisher 500, and transmits contents of an operation mode of the finisher 500 based on the instruction to a finisher control section 951 through the communication IF 307.

In terms of the image forming apparatus 10, the operation section 400 mainly receives an instruction for instructing the printer 300 to execute the print job. Meanwhile, an instruction for a binding job is mainly transmitted to the finisher 500.

In a case where printing (image formation) of a plurality of copies involving the binding process is performed, the operation section 400 receives information on the number of copies (copy sets) to be processed. Specifically, the information on the number of copies to be processed is information representing a pair of a number of copies being a number of stacks of the paper sheets P used when the stapling process is performed (referred to as "number of copies to be stapled" or simply as "first number of copies") and a number of copies being a number of stacks of the paper sheets P used when the eco-stapling process is performed (referred to as "number of copies to be eco-stapled" or simply as "second number of copies"). Alternatively, the information on the number of copies to be processed may be a pair of one of the first number of copies and the second number of copies and a coefficient for deriving the other number of copies from the one number of copies. Alternatively, the information on the number of copies to be processed may be a pair of a total number of copies of the sheet materials to be subjected to the binding process and the first number of copies or the second number of copies. Alternatively, the information on the number of copies to be processed may be a pair of the total number of copies and a coefficient (ratio) for deriving the first number of copies and the second number of copies from the total number of copies. The information on the number of copies to be processed serves to determine contents of a job so that the number of copies to be subjected to the two kinds of binding process is equal to or larger than the total number of copies and to further allow the first number of copies and the second number of copies included in one job to be identified in the printer control section 304 or the finisher control section 951.

The display section 401 includes a display. Examples displayed on the display include a monitoring screen for displaying a state of the image forming apparatus 10 and a screen for receiving an instruction for each kind of setting from the user.

The finisher 500 includes the binding section 520, a conveying-system device group 901, a communication IF 916, and the finisher control section 951.

The binding section 520 includes a stapling motor 701, a stapler moving motor 702, a staple presence/absence detecting sensor 703, and the above-mentioned eco-stapling motor 704, and performs the stapling process and the eco-stapling process for the paper sheet P.

The conveying-system device group 901 is formed of various rollers such as the conveying rollers 501 and the like, the buffer path roller 503, and the discharge rollers 512 illustrated in FIG. 1, motors for driving the rollers, the flapper 507, and the like, and conveys the paper sheet P. Conveyance sensors (not shown) for identifying a conveyance state of the paper sheet P are arranged in predetermined portions.

The communication IF 916 is an interface for connecting the image reader 200 and the printer 300 to each other in a communicable manner.

The finisher control section 951 is a kind of computer for controlling each section of the finisher 500 by a CPU 952 executing a predetermined control program recorded in a memory 953.

The finisher control section 951 communicates data such as the print command, the binding job, and a sheet handover notification to/from the printer 300, the operation section 400, and the finisher 500 through the communication IF 916. For example, the finisher control section 951 controls the binding section 520 to perform the binding process for the paper sheets P when the binding job is instructed in the print command received from the host computer 600 or when the instruction for the binding job is received from the operation section 400.

Further, the finisher control section 951 determines whether or not the number of paper sheets forming one copy is within an allowable range of the binding process. When a notification of the number of paper sheets is received from the printer control section 304, the finisher control section 951 performs the determination based on contents of the notification. When the notification is not received from the printer control section 304, the finisher control section 951 performs the determination based on a result of detection performed by a paper sheet sensor provided to a binding position. Then, the finisher control section 951 permits the stapling process when the number of paper sheets is within the allowable range of the stapling process, and permits the eco-stapling process when the number is within the allowable range of the eco-stapling process.

(Operation of Image Forming System)

Next, an operation of the image forming system according to this embodiment is described.

Here, a description is made of a control procedure performed in a case where the finisher 500 executes the stapling process and the eco-stapling process in one job in accordance with the instruction received from the user through the operation section 400.

The job executed in this case is enabled by, for example, the user setting the number of copies to be subjected to the stapling process or the eco-stapling process through the operation section 400 under the print command received from the host computer 600. That is, the binding job for performing the binding process is included in the print command. By this setting performed through the operation section 400, the image forming system outputs the stacks of the image-formed paper sheets P that have been subjected to the stapling process and the eco-stapling process in one job.

Figure 5:
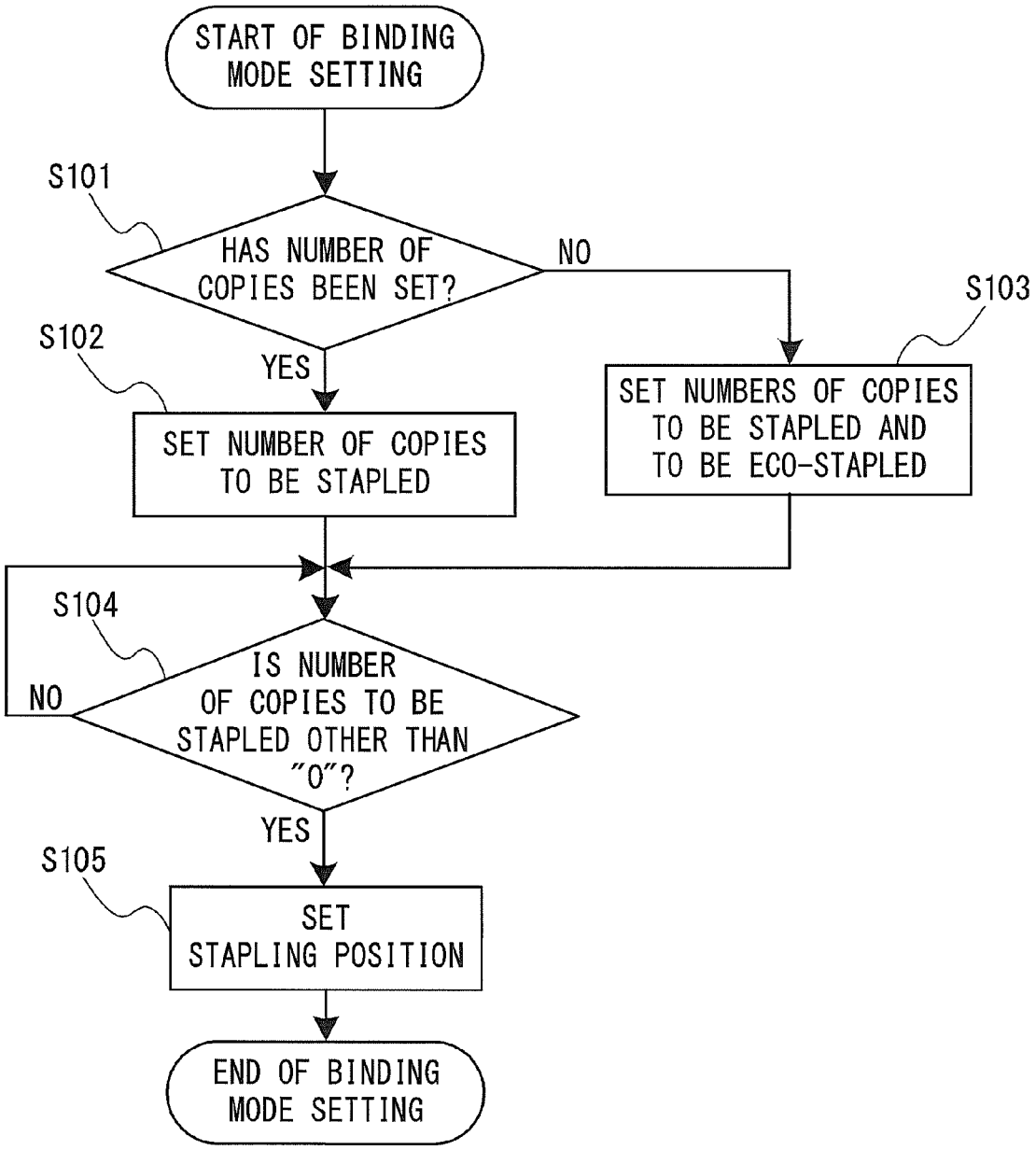
FIG. 5 is an explanatory diagram of a control procedure performed by a printer control section in a binding mode setting.

FIG. 5 is an explanatory diagram of a control procedure performed in a case where the binding job is involved under the print command as the operation mode of the image forming system. In this case, the control is performed by the printer control section 304 (CPU 305). FIGS. 6A and 6B and FIGS. 7A and 7B illustrate display examples of a screen displayed by the display section 401 when the binding job is set. This control is executed when the user presses a "binding" button 801 on the display section 401 illustrated in FIG. 6A. When the "binding" button 801 is pressed to start an operation, the printer control section 304 determines whether or not the number of copies to be printed has been set through the operation section 400 (S101).

When the number of copies to be printed has been set (S101: YES), the printer control section 304 displays, on the display section 401, the screen for instructing the user to set the number of copies to be stapled as illustrated in FIG. 6B (S102). In the example of the displayed screen illustrated in FIG. 6B, the user is allowed to set the number of copies to be stapled by counting up/down the number of copies with a black triangle button 802 and an inverted black triangle button 803.

In default, the set number of copies to be printed is displayed as the number of copies to be stapled as it is with the number of copies to be eco-stapled being "0". As the number of copies to be stapled is decreased with the inverted black triangle button 803, the number of copies to be eco-stapled increases. Further, as the number of copies to be stapled is increased with the black triangle button 802, the number of copies to be eco-stapled is decreased. Upper limits of the number of copies to be stapled and the number of copies to be eco-stapled are the set number of copies to be printed.

Figure 7A:
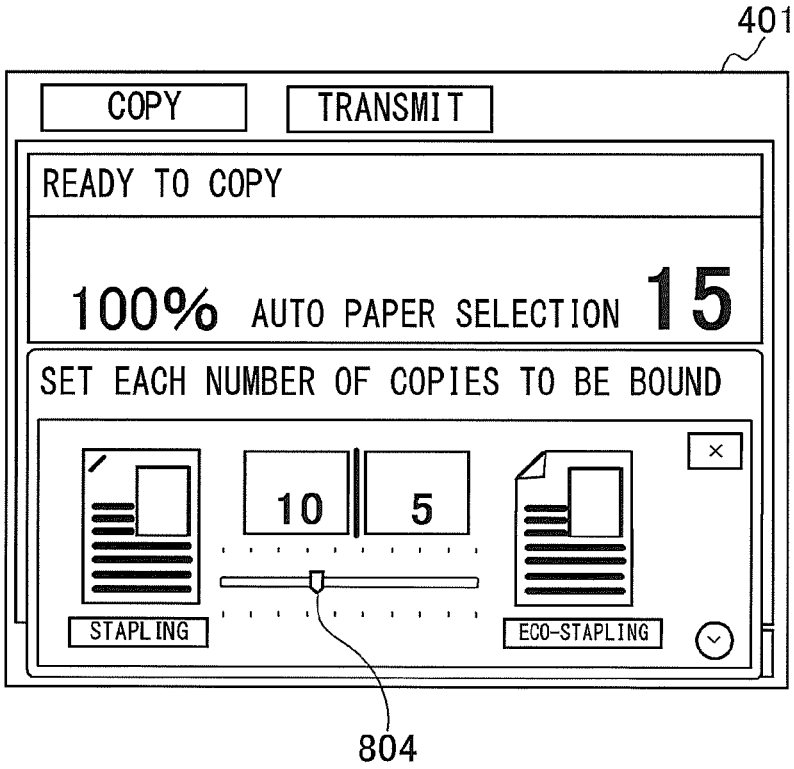
FIG. 7A is a display example of the screen displayed in the binding mode setting.

Here, the number of copies to be eco-stapled is (M−N) where "M" and "N" represent the number of copies to be printed and the set number of copies to be stapled, respectively. It should be understood here that the number of copies to be eco-stapled may be set instead of the number of copies to be stapled. Alternatively, as illustrated in FIG. 7A, the user can operate a slider 804 to adjust the proportion between the number of copies to be stapled and the number of copies to be eco-stapled, to thereby set the number of copies for each binding process. The printer control section 304 applies this proportion to the total number of copies, to thereby set the number of copies for each binding process.

Further, as values displayed in default, the set number of copies to be printed may be the number of copies to be eco-stapled, and the number of copies to be stapled may be a value (when the number of copies is an even number) half of the number of copies to be printed or a value (when the number of copies is an odd number) half of a value obtained by adding "1" to the number of copies to be printed.

Figure 7B:
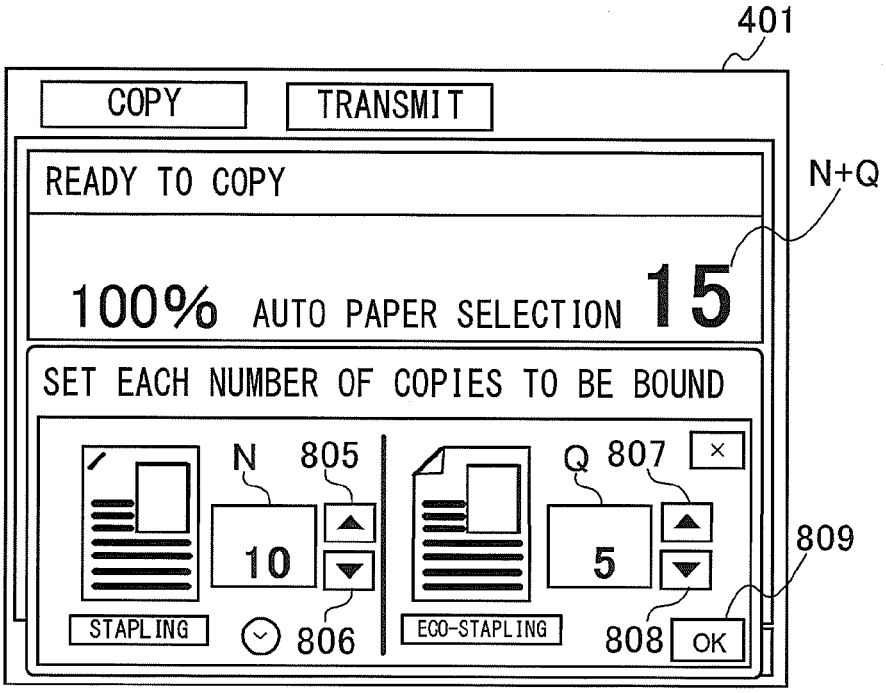
FIG. 7B is a display example of the screen displayed in the binding mode setting.

When an operation for setting the number of copies to be printed as a whole has not been performed (S101: NO), the printer control section 304 controls the display section 401 to perform display for instructing the user to separately set the number of copies to be stapled and the number of copies to be eco-stapled (S103). A display example thereof is illustrated in FIG. 7B. In the example of FIG. 7B, a black triangle button 805 and an inverted black triangle button 806 for instructing to set the number of copies to be stapled and a black triangle button 807 and an inverted black triangle button 808 for instructing to set the number of copies to be eco-stapled are displayed, to thereby enable separate settings of the number of copies to be stapled and the number of copies to be eco-stapled. As values displayed in default, the number of copies to be stapled is "1", and the number of copies to be eco-stapled is "0", but the present disclosure is not limited to those values.

The number of copies to be printed as a whole is a numerical value of "N+Q" where "N" and "Q" represent the set number of copies to be stapled and the number of copies to be eco-stapled, respectively, and is reflected in the display of the number of copies to be printed. The number of copies to be printed is fixed by the user pressing an OK button 809.

After the number of copies is set by the user, the printer control section 304 determines whether or not the number of copies to be stapled is other than "0" (S104). When the number of copies to be stapled is not "0" (S104: YES), the printer control section 304 displays a screen for instructing the user to set a stapling position on the display section 401 (S105). After a stapling position setting is finished, a binding mode setting is brought to an end.

The stapling position setting represents a setting regarding which corner of the paper sheet stack is to be stapled, in other words, which of the depth side and the front side relative to the front surface of the apparatus is used to perform the stapling process with the stapler 601 illustrated in FIG. 2A.

There is also a case where a stapling job for performing the stapling process and an eco-stapling job for performing the eco-stapling process are input through the operation section 400 as one binding job execution instruction independently of the host computer 600. The job performed at this time is referred to as the finisher job. The finisher job is also performed by the printer control section 304 (CPU 305).

Figure 8:
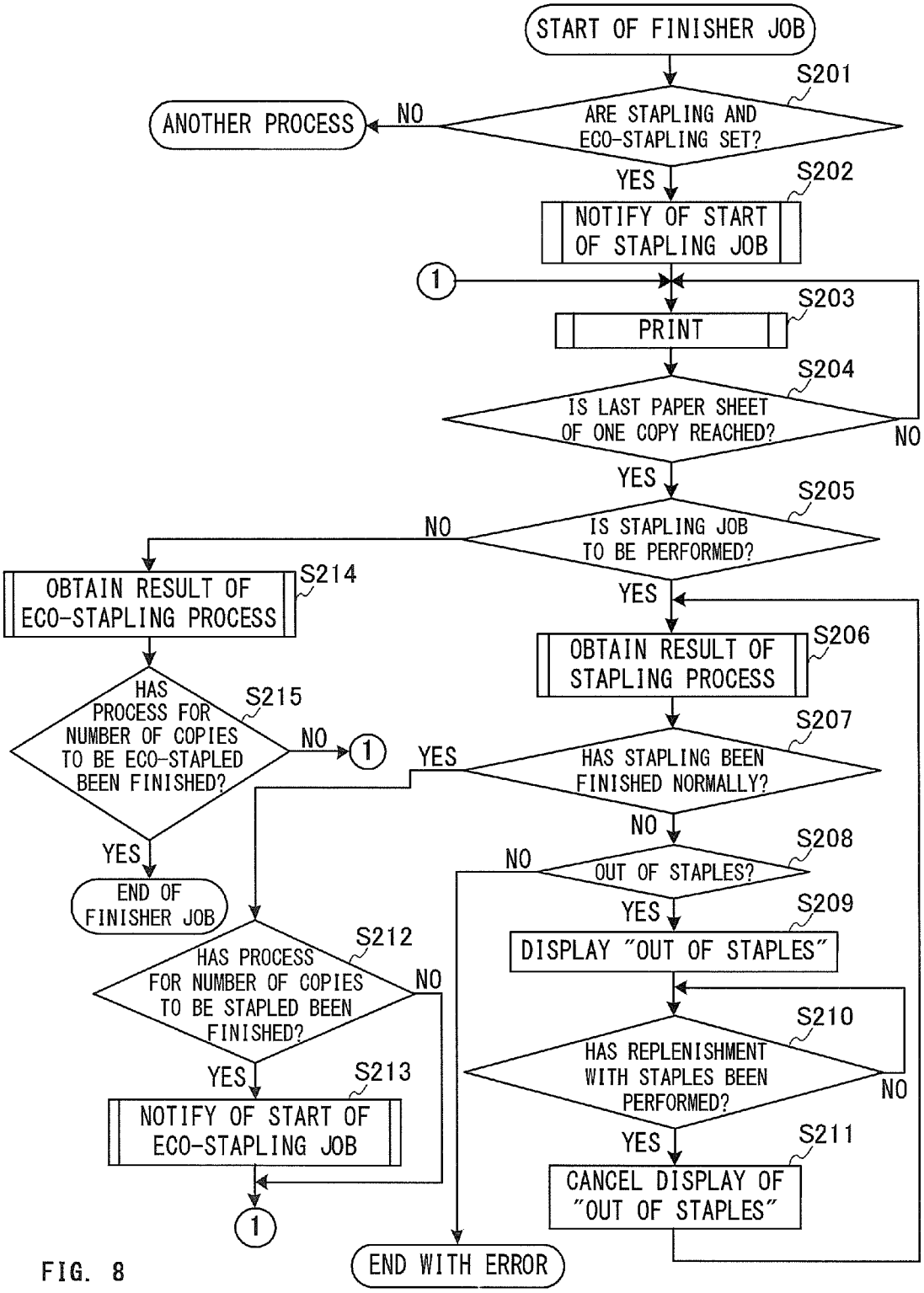
FIG. 8 is an explanatory diagram of a procedure performed to execute a job using the finisher.

FIG. 8 is an explanatory diagram of a control procedure performed by the printer control section 304 (CPU 305) to execute the finisher job. Here, a description is made of a case where the stapling job is performed first when both the stapling job and the eco-stapling job are set.

The printer control section 304 determines whether or not both the stapling job and the eco-stapling job are set (S201). When one thereof or none thereof is set (S201: NO), the printer control section 304 performs another process. The other process is irrelevant to this embodiment, and hence a description thereof is omitted.

When both are set (S201: YES), the printer control section 304 first notifies the finisher 500 of a start of the stapling job (S202). At this time, the printer control section 304 also notifies of the number of copies to be stapled. After that, the printer control section 304 prints the image on each paper sheet (S203). The printer control section 304 repeats the printing process up to the last paper sheet of one copy (S204: NO).

When the printing is finished up to the last paper sheet of one copy (S204: YES), the printer control section 304 determines which of the stapling job and the eco-stapling job is to be performed (S205). Here, the stapling job is to be performed first, and hence the printer control section 304 causes the finisher 500 to execute the stapling process (S205: YES), and obtains an execution result of the stapling process (S206). The control procedure during the stapling process is described later.

After that, the printer control section 304 determines whether or not the stapling process performed by the finisher 500 has been finished normally through communications to/from the finisher control section 951 (CPU 952) (S207). When the stapling job has not been finished normally (S207: NO), the printer control section 304 determines whether or not cause to fail to finish the stapling job normally is that the stapler 601 has run out of staples (S208). When it is determined that the stapling job has not been finished normally for cause other than the running out of staples (S208: NO), the printer control section 304 assumes that an abnormality has occurred in the finisher 500, and ends the job with an error.

On the other hand, when the stapling process has not been finished normally because the stapler 601 has run out of staples (S208: YES), the printer control section 304 displays the fact of having run out of staples on the display section 401 (S209), and waits for the user to perform replenishment with staples (S210). When determining that the replenishment with staples has been performed based on an output from the staple presence/absence detecting sensor 703 (S210: YES), the printer control section 304 cancels the "out of staples" display of the display section 401 (S211), and returns to Step S206 to restart the stapling process.

When the stapling job performed by the finisher 500 has been finished normally (S207: YES), the printer control section 304 determines whether or not the process for the set number of copies to be stapled has been finished (S212). The printer control section 304 returns to Step S203 to keep acquiring the result of the stapling process until determining that the process for the set number of copies to be stapled has been finished (S212: NO).

When the process for the set number of copies has been finished (S212: YES), the printer control section 304 notifies the finisher 500 of a start of the eco-stapling job (S213). After that, the printer control section 304 returns to Step S203 to execute the eco-stapling job.

The job being executed is not the stapling job (S205: NO), and hence the printer control section 304 obtains an execution result of the eco-stapling process from the finisher 500 (S214). The printer control section 304 returns to Step S203 to wait for the execution result of the eco-stapling process until the process for the eco-stapling job for the set number of copies is finished (S215: NO). When the process for the set number of copies has been finished (S215: YES), the printer control section 304 assumes that the finisher job has been finished, and brings the control to an end.

Note that, the description is made here on the assumption that the stapling job is executed first, but the control may be performed to process the eco-stapling job first. Alternatively, the user may be allowed to select which binding is to be processed first.

Figure 9:
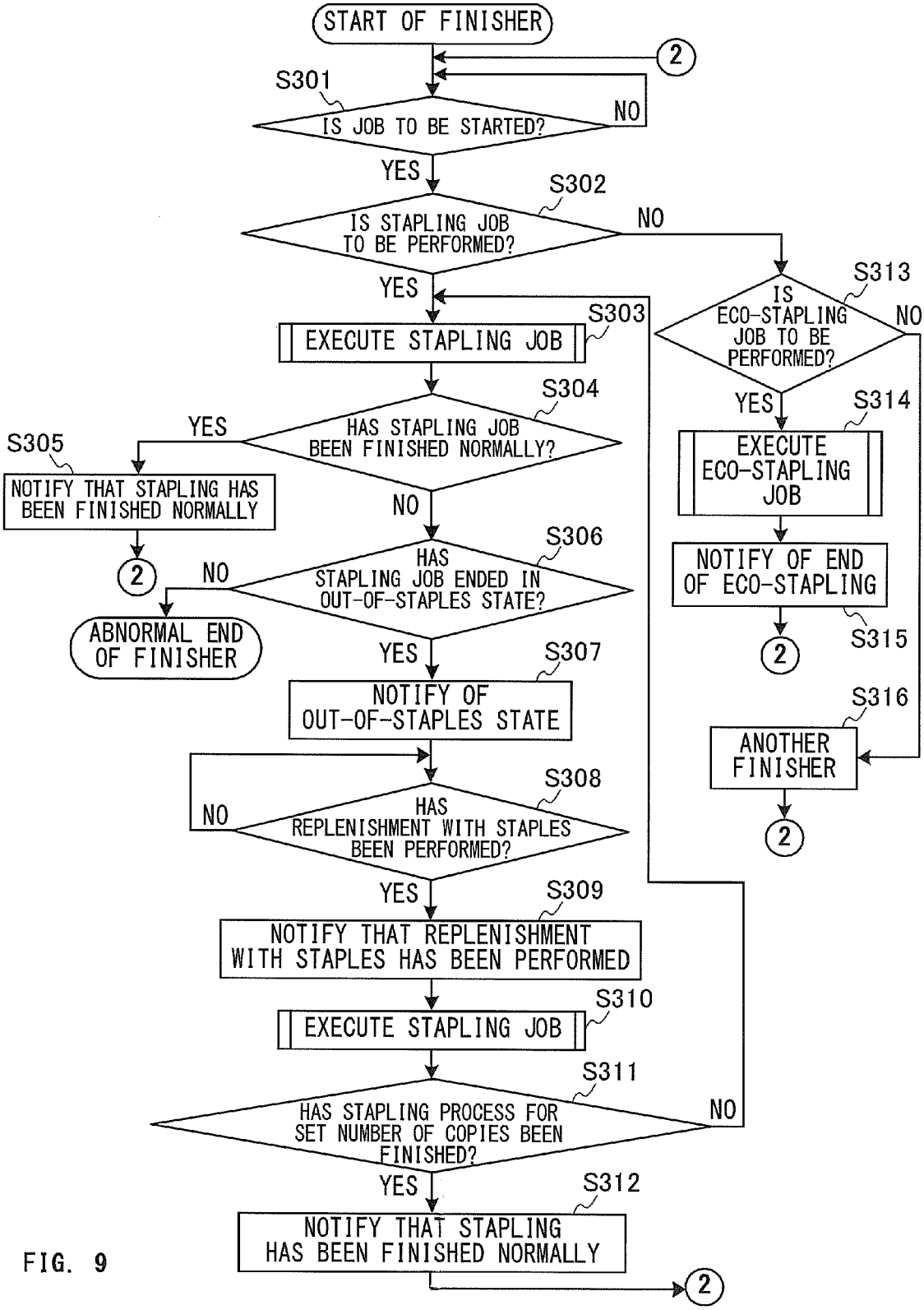
FIG. 9 is an explanatory diagram of a procedure for job control of a CPU using the finisher.

FIG. 9 is an explanatory diagram of a procedure for control of the finisher control section 951 (CPU 952) in the processing procedure illustrated in FIG. 8. When receiving the start of the finisher job from the printer control section 304 (S301:

YES), the finisher control section 951 determines a kind of the received finisher job (S302). In this embodiment, the stapling job is to be performed first (S302: YES), and hence the finisher control section 951 executes the stapling process up to the set number of copies (S303). When the stapling job has been finished normally (S304: YES), the finisher control section 951 notifies the printer control section 304 of a result of the stapling process (finished normally) (S305). After that, the finisher control section 951 returns to a job start standby state.

When the stapling job has not been finished normally (S304: NO), the finisher control section 951 determines whether or not the cause is that no staples exist, in other words, the stapling job has ended in an out-of-staples state (S306). In the case of not being the out-of-staples end (S306: NO), the finisher control section 951 notifies the printer control section 304 that the finisher 500 has entered an abnormal state, and brings the process to an end.

In the case of being the out-of-staples end in S306 (S306: YES), the finisher control section 951 notifies the printer control section 304 of the out-of-staples state (S307). The printer control section 304 displays the fact of being in the out-of-staples state on the operation section 400 (display section 401). After the notification, the finisher control section 951 waits for the user to perform the replenishment with staples (S308). When it turns out that the replenishment with staples has been performed based on the output from the staple presence/absence detecting sensor 703 (S308: YES), the finisher control section 951 notifies the printer control section 304 that the replenishment with staples has been performed (S309), and restarts the stapling process (S310). After that, the finisher control section 951 determines whether or not the stapling process for the set first number of copies has been finished. When the stapling process has not been finished for the set first number of copies (S311: NO), the finisher control section 951 returns to Step S303 to repeat the stapling process. When the stapling process for the first number of copies has been finished (S311: YES), the finisher control section 951 notifies the printer control section 304 of the result of the stapling process (finished normally) (S312), and returns to the job start standby state.

After the stapling job is finished (S302: NO), the finisher control section 951 determines whether or not the eco-stapling job is to be performed (S313). When the eco-stapling job is to be performed (S313: YES), the finisher control section 951 executes the eco-stapling process (S314). When the eco-stapling process has been finished, the finisher control section 951 notifies the printer control section 304 of an eco-stapling end result (S315), and returns to the job start standby state.

When it is determined in S313 that the eco-stapling job is not to be performed (S313: NO), the finisher control section 951 assumes the process as another post-process, and executes the process (S316).

Next, a description is made of control procedures performed during the stapling process and during the eco-stapling process.

Figure 10:
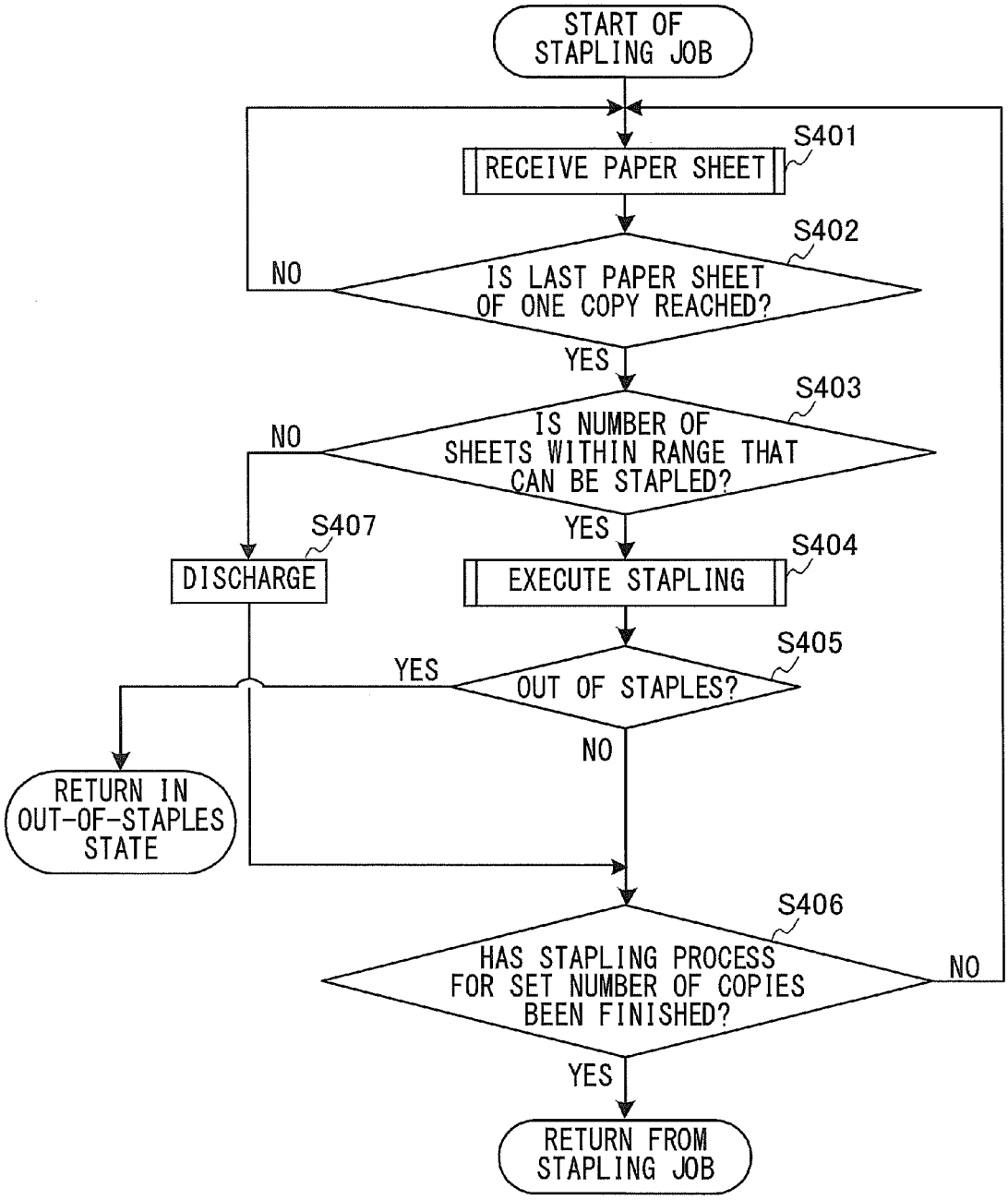
FIG. 10 is an explanatory diagram of a control procedure performed by the finisher control section during a stapling process.

FIG. 10 is an explanatory diagram of the control procedure performed during the stapling process executed by the finisher control section 951. When receiving an instruction to execute the stapling job, the finisher control section 951 controls the conveying-system device group 901 to convey the paper sheet P received from the printer 300 to the binding section 520 and to stack and align the paper sheets P (S401). The finisher control section 951 repeats a process of Step S401 up to the last paper sheet of one copy (S402).

The finisher control section 951 determines whether or not the number of paper sheets of the paper sheet stack that has been received falls within a range of the number of sheets that can be stapled (S403). When the number falls within the range of the number of sheets that can be stapled (S403: YES), the finisher control section 951 controls the stapler 601 to execute the stapling for the paper sheet stack (S404). When determining that there are no staples based on the output from the staple presence/absence detecting sensor 703 (S405: YES), the finisher control section 951 assumes to have detected that there are no staples, and brings the control to an end. When determining that the number falls out of the range of the number of sheets that can be stapled (S403: NO), the finisher control section 951 discharges the paper sheet stack as it is without performing an alternative binding process (S407).

When not detecting the out-of-staples state (S405: NO), the finisher control section 951 determines whether or not the stapling process for the set number of copies has been finished (S406). When the stapling process for the set number of copies has not been finished (S406: NO), the finisher control section 951 returns to Step S401 to continue the stapling process for the remaining number of copies. When the stapling process for the set number of copies has been finished (S406: YES), the finisher control section 951 brings the control for the stapling job to an end.

Figure 11:
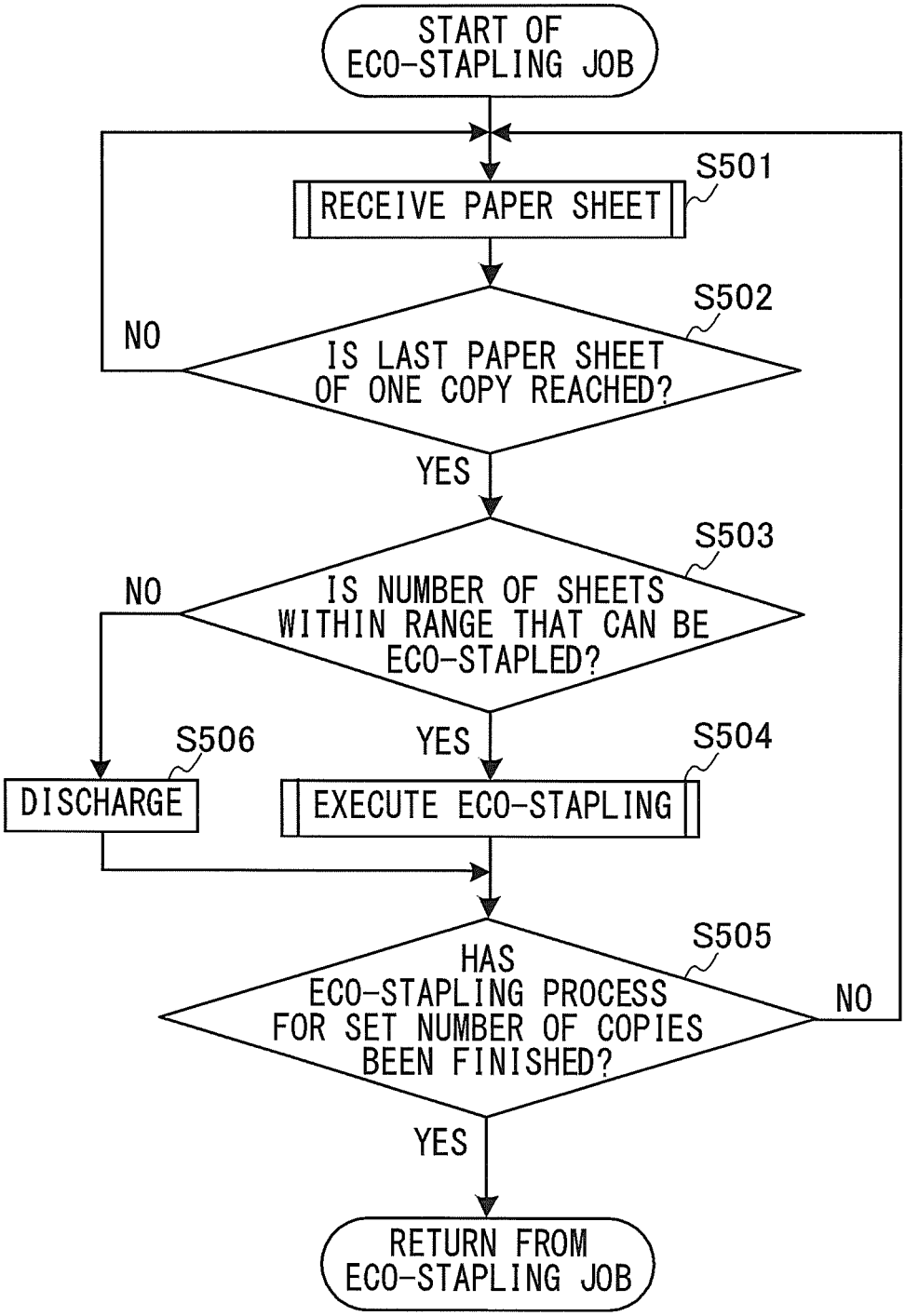
FIG. 11 is an explanatory diagram of the control procedure performed by the finisher control section during an eco-stapling process.

FIG. 11 is an explanatory diagram of the control procedure performed during the eco-stapling process executed by the finisher control section 951.

When receiving a notification of the start of the eco-stapling job from the printer 300, the finisher control section 951 controls the conveying-system device group 901 to convey the paper sheet P to the binding section 520 and to stack and align the paper sheets P (S501). The finisher control section 951 repeats the control until the last paper sheet of one copy is aligned (S502).

The finisher control section 951 determines whether or not the number of paper sheets of the paper sheet stack that has been received falls within a range of the number of sheets that can be eco-stapled (S503). When the number falls within the range of the number of sheets that can be eco-stapled (S503: YES), the finisher control section 951 controls the eco-stapler 650 to execute the eco-stapling for the paper sheet stack (S504). On the other hand, when determining that the number falls out of the range of the number of sheets that can be eco-stapled (S503: NO), the finisher control section 951 discharges the paper sheet stack as it is without performing an alternative binding process in the same manner as in the stapling (S506).

After that, the finisher control section 951 determines whether or not the process for the set number of copies has been finished (S505). When there is an unfinished process left (S505: NO), the finisher control section 951 returns to Step S501 to continue the eco-stapling process for the remaining number of copies. When determining that the eco-stapling process for the set number of copies has been finished (S505: YES), the finisher control section 951 brings the control for the eco-stapling job to an end.

Note that, in this embodiment, the eco-stapler 650 using a method of bringing the paper sheet stack into a press contact with the upper teeth 670 and the lower teeth 674 is used, but a method of binding papers sheets without using a staple according to the present disclosure is not limited thereto. For example, it is possible to use an eco-stapler using a method of providing notches to the paper sheet stack and folding the notches over each other, to thereby prevent the paper sheet stack from falling apart.

In this manner, in the image forming system according to this embodiment, the number of copies to be stapled and the number of copies to be eco-stapled can be set to execute the stapling process and the eco-stapling process in one job. Therefore, for example, when both the stapling process and the eco-stapling process are desired for the same original, it is possible to reduce time and labor for performing two settings and two print instructions based on the respective kinds of binding process, and an improvement in operability can be expected.

Note that, in this embodiment, the description is made by taking, as examples of the post-process, a case of performing the stapling process as the first binding process and the eco-stapling process as the second binding process, but the post-process according to the present disclosure is not limited to those binding processes. For example, a folding process for merely folding paper sheets, an insertion process for inserting another paper sheet, or the like can be performed as the first binding process or the second binding process.

Further, in this embodiment, the description is made of an exemplary case where an input of the information on the number of copies to be processed is received through the operation section 400, but the present disclosure is not limited to such a mode. For example, the information on the number of copies to be processed may be received by being included in the job received from the computer to the image forming apparatus 10 instead of being received by the user's input operation through the operation section 400.

Second Embodiment

In the first embodiment, the description has been made of the control for outputting two kinds of binding process including the stapling process (first binding process) and the eco-stapling process (second binding process) to one print job in a series of flow. In a second embodiment of the present disclosure, a description is made of control for performing three kinds of process including a no-binding process in addition to the stapling process and the eco-stapling process in a series of flow by the same image forming system as in the first embodiment. An overall structure, an explanatory diagram of the paper sheet position used when the binding process is performed, an explanatory diagram of the eco-stapler, and a functional configuration diagram of an image forming system including an image forming apparatus according to the second embodiment are the same as those of FIG. 1 to FIG. 4 for illustrating the first embodiment, and hence a description thereof is omitted. Further, FIG. 6A illustrating a display example of the binding mode setting is also common with the first embodiment.

For example, a case where the stapling is used for formal handouts for review, the eco-stapling is used for handouts having the same contents for internal use, and no-binding is used for a presenter is conceivable as a use case of performing the three kinds of process in a series of flow.

Figure 6A:
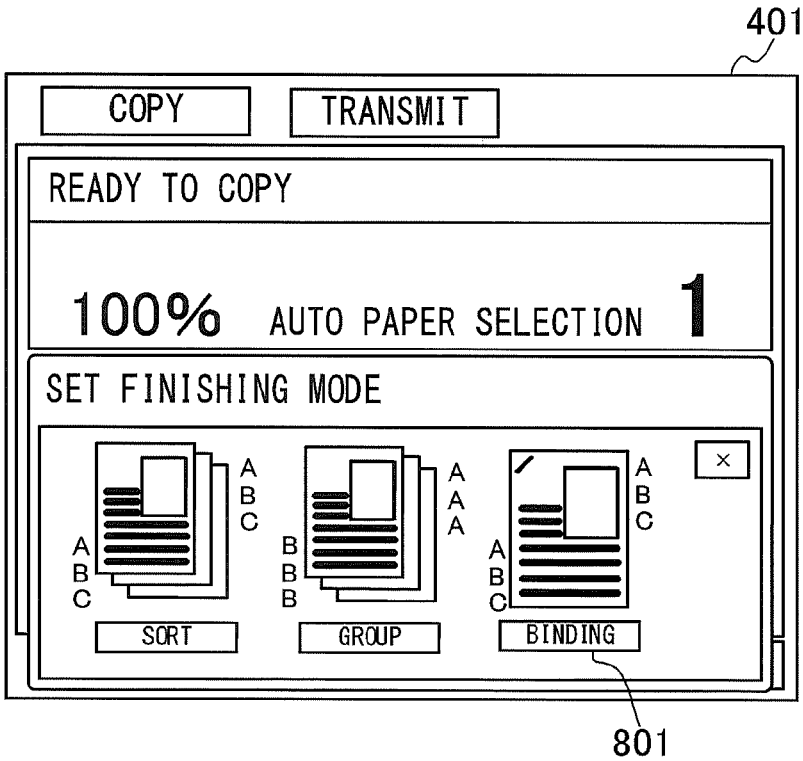
FIG. 6A is a display example of a screen displayed in the binding mode setting.
Figure 6B:
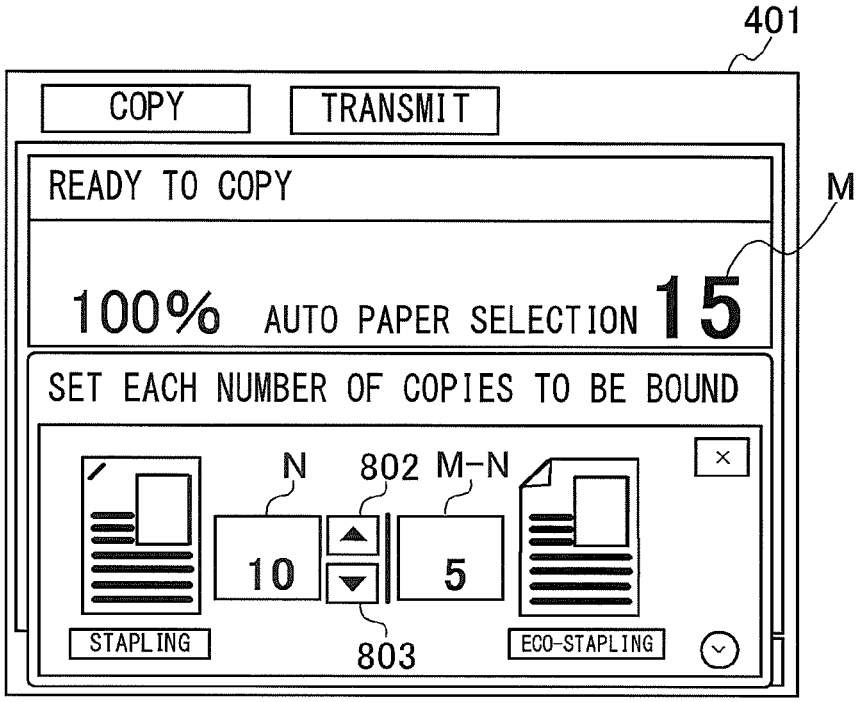
FIG. 6B is a display example of the screen displayed in the binding mode setting.
Figure 12:
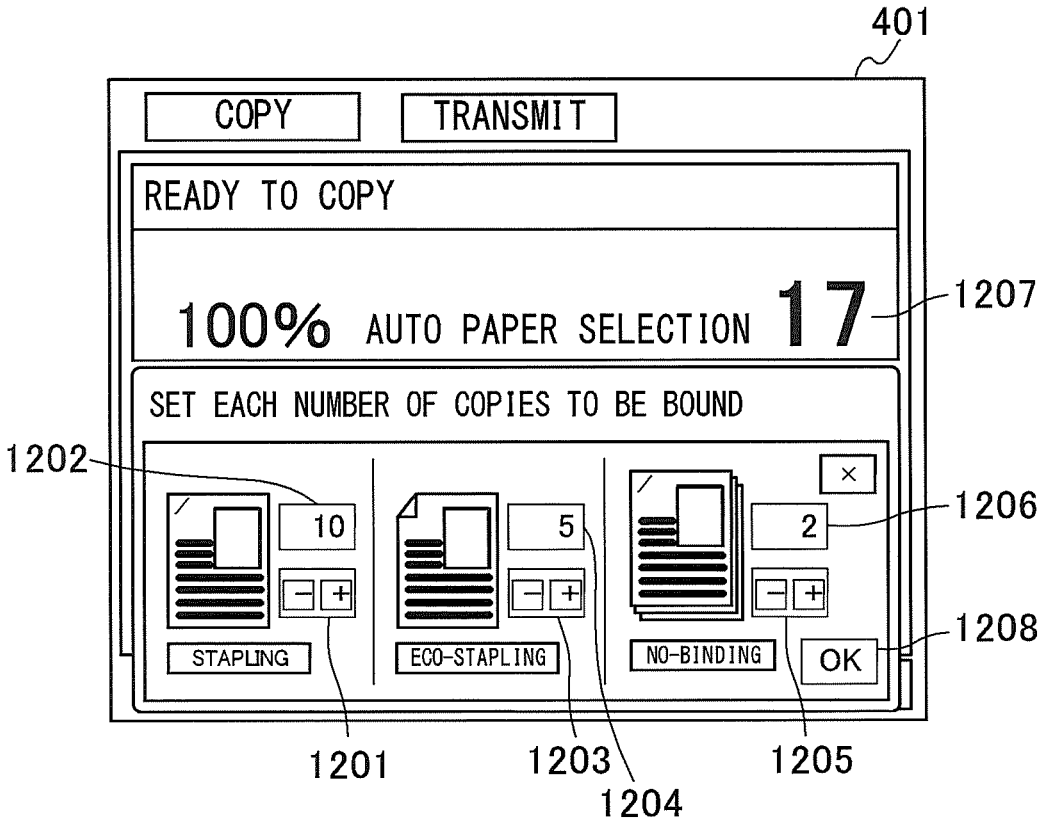
FIG. 12 is a display example of a screen displayed in the binding mode setting.

FIG. 12 is a display example of the binding mode setting in the display section 401 of the printer 300, and illustrates a screen displayed when the "binding" button 801 illustrated in FIG. 6A is pressed.

A plus (+) button and a minus (−) button of a button 1201 for setting the number of copies to be stapled are operated, to thereby set the value of a number of copies to be stapled (first number of copies) 1202. The plus (+) button and the minus (−) button of a button 1203 for setting the number of copies to be eco-stapled are operated, to thereby set the value of a number of copies to be eco-stapled 1204 (second number of copies). The plus (+) button and the minus (−) button of a button 1205 for setting a number of copies without binding are operated, to thereby set the value of a number of copies without binding 1206 (third number of copies). A total sum of the respective values of the number of copies to be stapled 1202, the number of copies to be eco-stapled 1204, and the number of copies without binding 1206 becomes a number of copies to be printed 1207 for the job. When an OK button 1208 is pressed, the respective set numbers of copies to be stapled, copies to be eco-stapled, and copies without binding are fixed, and the screen for setting the number of copies is closed.

Figure 13:
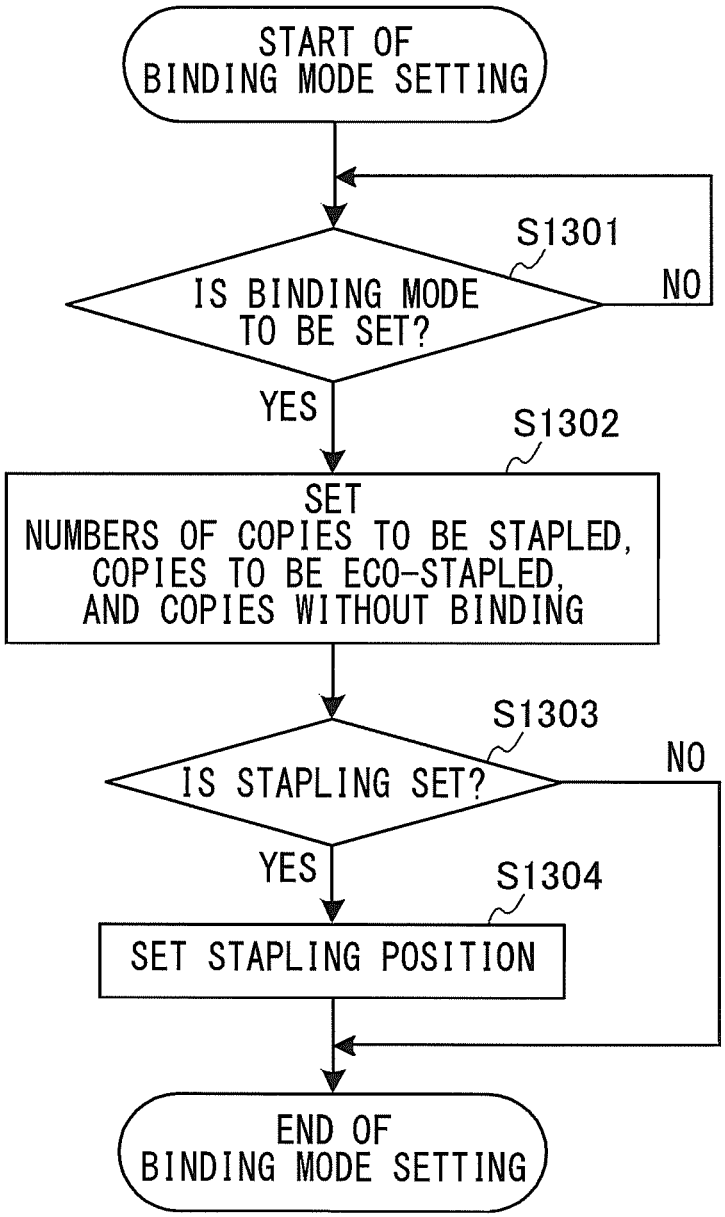
FIG. 13 is an explanatory diagram of a control procedure performed by the printer control section in the binding mode setting.

FIG. 13 is an explanatory diagram of the control procedure performed by the operation section 400 for the binding mode setting according to the second embodiment. In this case, the control is performed by the printer control section 304 (CPU 305).

The printer control section 304 waits until a setting of a binding mode is started (S1301). Specifically, the printer control section 304 waits until the user presses the "binding" button 801 on the display section 401 illustrated in FIG. 6A. When the setting of the binding mode is started (S1301: YES), the printer control section 304 instructs the user to set respective values of the number of copies to be stapled, the number of copies to be eco-stapled, and the number of copies without binding (S1302). The user is instructed by such display as illustrated in FIG. 12.

After the numbers of copies have been set by the user, the printer control section 304 determines whether or not the stapling is set based on whether or not the set number of copies to be stapled is other than "0" (S1303). When determining that the stapling is not set (S1303: NO), the printer control section 304 brings the binding mode setting to an end as it is.

On the other hand, when determining that the stapling is set (S1303: YES), the printer control section 304 instructs the user to set the stapling position (S1304). The printer control section 304 brings the binding mode setting to an end after the end of the stapling position setting. The stapling position setting is a setting regarding which corner of the paper sheet stack is to be stapled, in other words, which of the depth side and the front side relative to the front surface of the apparatus is used to process the stapling with the stapler 601 illustrated in FIG. 2A.

Figure 14:
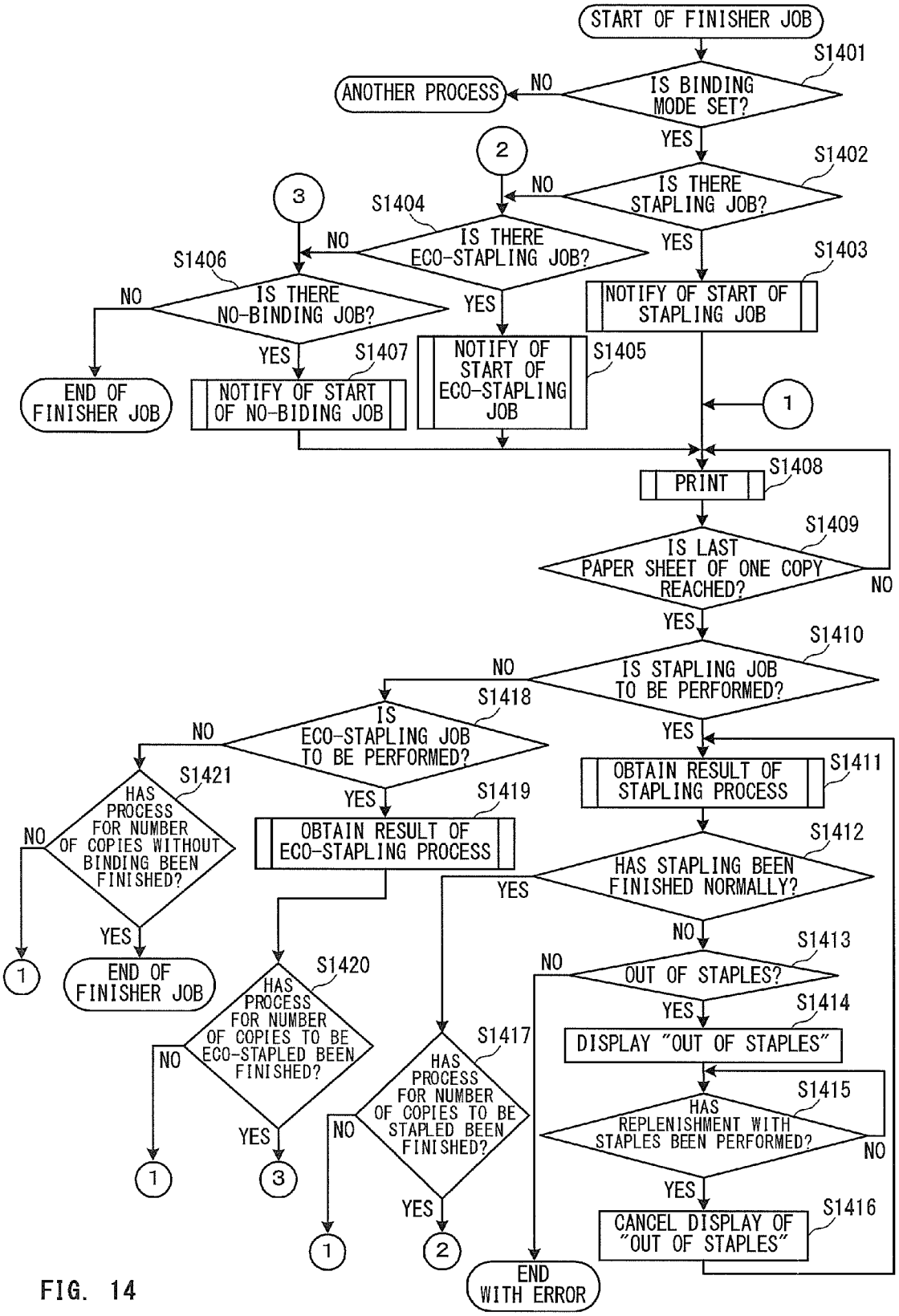
FIG. 14 is an explanatory diagram of a procedure performed to execute a job using the finisher.

FIG. 14 is an explanatory diagram of the control procedure performed by the printer control section 304 (CPU 305) to execute the finisher job.

The printer control section 304 determines whether or not any one of the binding modes for the stapling and the eco-stapling is set (S1401). When the binding mode is not set (S1401: NO), the printer control section 304 performs another process. This other process is irrelevant to this embodiment, and hence a description thereof is omitted.

When the binding mode is set (S1401: YES), the printer control section 304 determines whether or not the number of copies to be stapled is equal to or larger than 1 (S1402). When the number of copies to be stapled is equal to or larger than 1 (S1402: YES), the printer control section 304 notifies the finisher 500 of the start of the stapling job (S1403), and executes printing of the image (S1408).

When the number of copies to be stapled is set to "0" (S1402: NO), the printer control section 304 determines whether or not the number of copies to be eco-stapled is equal to or larger than 1 (S1404). When the number of copies to be eco-stapled is equal to or larger than 1 (S1404: YES), the printer control section 304 notifies the finisher 500 of the start of the eco-stapling job (S1405), and executes the printing of the image (S1408).

When the number of copies to be eco-stapled is "0" (S1404: NO), the printer control section 304 determines whether or not the number of copies without binding, which are not to be subjected to the binding process, is equal to or larger than 1 (S1406). When the number of copies without binding is equal to or larger than 1 (S1406: YES), the printer control section 304 notifies the finisher 500 of the start of a no-binding job (S1407), and executes the printing of the image (S1408). The no-binding process performed by the finisher 500 is described later. Note that, when the number of copies without binding is "0" (S1406: NO), the printer control section 304 determines that all the jobs have been finished, and brings the process to an end.

The printer control section 304 keeps executing the printing until the printing of the last paper sheet defining one copy is determined (S1409). After the printing of one copy has been finished (S1409: YES), the printer control section 304 determines whether or not the job being executed is the stapling job (S1410).

In the case where the job is the stapling job (S1410: YES), the printer control section 304 obtains the execution result of the stapling process from the finisher 500 (S1411). The stapling process performed by the finisher 500 is the same as in the first embodiment (process illustrated in FIG. 10). The printer control section 304 determines based on the obtained execution result of the binding process whether or not the stapling process performed by the finisher 500 finished normally (S1412). When the stapling job has not finished normally (S1412: NO), the printer control section 304 determines whether or not the cause for failing to finish the stapling job normally is that the stapler 601 has run out of staples (S1413). When it is determined that the stapling job has not been finished normally for a cause other than the running out of staples (S1413: NO), the printer control section 304 assumes that an abnormality occurs in the finisher 500, and ends the job with an error.

When the stapling process has not finished normally because the stapler 601 has run out of staples (S1413: YES), the printer control section 304 displays the fact of having run out of staples on the display section 401 (S1414), and waits for the user to perform the replenishment with staples (S1415). When it is determined that the replenishment with staples has been performed through the communications to/from the finisher control section 951 (S1415: YES), the printer control section 304 cancels "out of staples" display of the display section 401 (S1416), and returns to Step S1411 to restart the stapling process.

When determining that the job for the stapling process has been finished normally (S1412: YES), the printer control section 304 determines whether or not the printing process for the set number of copies to be stapled has been finished (S1417). The printer control section 304 returns to Step S1408 to repeat the printing of the image until determining that the printing process for the set number of copies to be stapled has been finished (S1417: NO).

When the printing process for the set number of copies is finished (S1417: YES), the printer control section 304 determines whether or not the eco-stapling job exists in the finisher 500 (S1404).

After the printing of one copy has been finished, when the job being executed is not the stapling job (S1410: NO), the printer control section 304 determines whether or not the job being executed is the eco-stapling job (S1418). In the case where the job is the eco-stapling job (S1418: YES), the printer control section 304 obtains the execution result of the eco-stapling process from the finisher 500 (S1419). The eco-stapling process performed by the finisher 500 is the same as in the first embodiment (process illustrated in FIG. 11).

The printer control section 304 determines whether or not the printing process for a predetermined number of copies of the eco-stapling job has been finished based on the execution result of the eco-stapling process (S1420). The printer control section 304 returns to Step S1408 to repeat the printing for the eco-stapling job until the printing process for the predetermined number of copies is finished (S1420: NO). When the printing process for the predetermined number of copies is finished (S1420: YES), the printer control section 304 executes determination as to whether or not the number of copies without binding is equal to or larger than 1 (S1406).

When the job being executed is not the eco-stapling job (S1418: NO), the job is the no-binding job. In this case, the printer control section 304 determines whether or not the printing process for the set number of copies of the no-binding job has been finished (S1421). The printer control section 304 returns to Step S1408 to repeat the printing process for the no-binding job until determining that the printing process for the set number of copies has been finished (S1421: NO). When determining that the printing process for the set number of copies has been finished, the printer control section 304 brings the process to an end (S1421: YES).

FIG. 14 illustrates the control for processing the stapling job, the eco-stapling job, and the no-binding job in the stated order, but the order of the processes according to the present disclosure is not limited thereto. Alternatively, the user may be allowed to select which binding mode is to be processed first.

Figure 15:
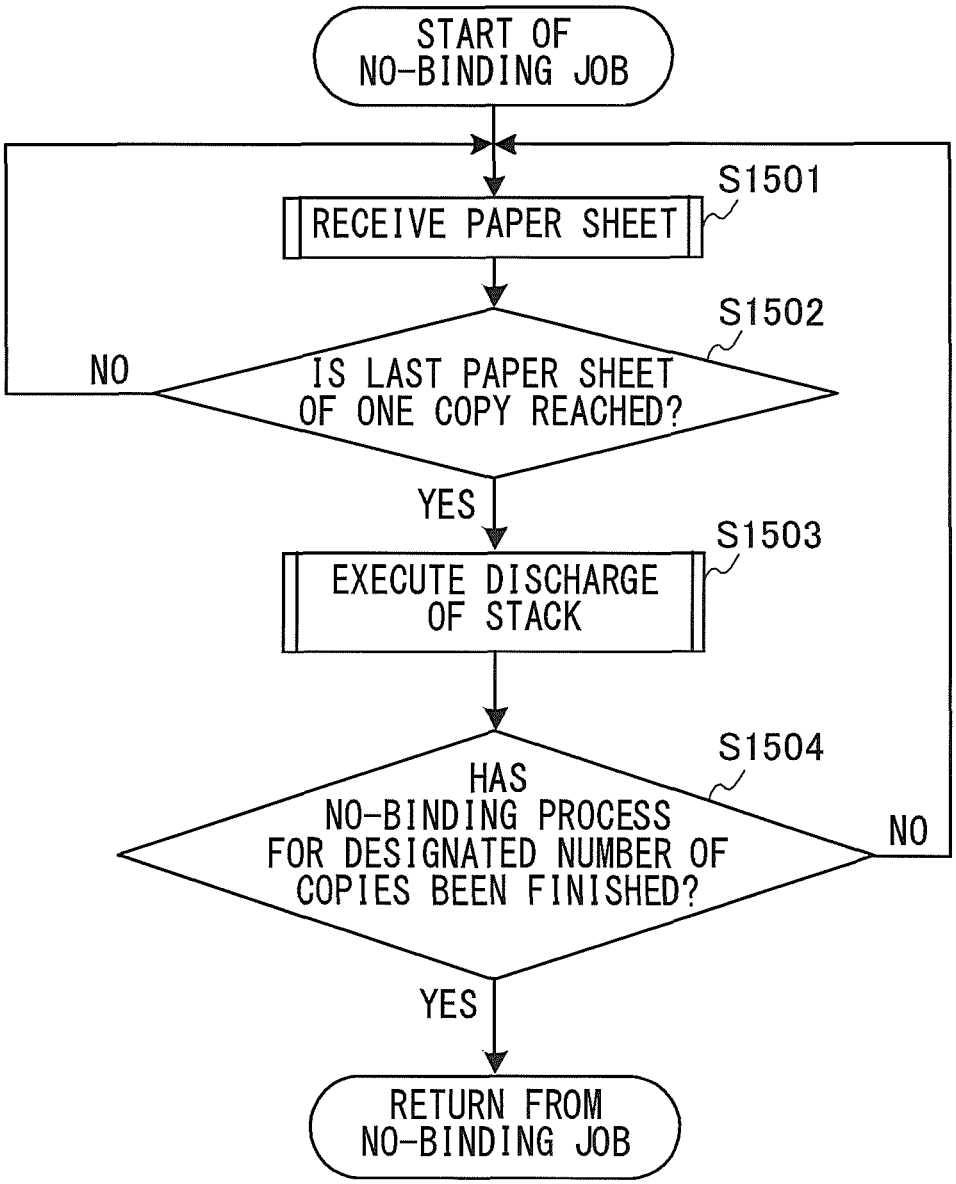
FIG. 15 is an explanatory diagram of a control procedure performed by the finisher control section during a no-binding process.

FIG. 15 is an explanatory diagram of the control procedure performed during the process for the no-binding job executed by the finisher control section 951.

When receiving a notification of the start of the no-binding job from the printer 300, the finisher control section 951 (CPU 952) conveys the received paper sheet P to the binding section 520 to stack and align the paper sheets P (S1501). The finisher control section 951 repeats this operation until the last paper sheet of one copy is reached (S1502). After the aligning has been performed up to the last paper sheet of one copy by the binding section 520 (S1502: YES), the finisher control section 951 discharges the aligned stack of the paper sheets P as an output stack for one copy (S1503). The finisher control section 951 repeats the process from Step S1501 until the stapling process for the designated number of copies has been finished (S1504). When determining that the no-binding process for the designated number of copies has been finished (S1504: YES), the finisher control section 951 brings the control for the no-binding job to an end.

In the second embodiment, the number of copies for which the stapling process is to be performed, the number of copies for which the eco-stapling process is to be performed, and the number of copies for which the no-binding process is to be performed are set for one print job in a series of operation, and can be executed in the form of job continuously on a regular basis. Therefore, it is possible to reduce the time and labor for performing a printing procedure three times separately, in other words, the job setting and execution for the stapling, the job setting and execution for the eco-stapling, and the job setting and execution for the no-binding, for the same original, which can improve the operability.

Further, it is conceivable that two numbers of copies selected from the first number of copies for which the stapling process is to be performed, the second number of copies for which the eco-stapling process is to be performed, and the third number of copies for which the no-binding process is to be performed and a total number of copies to be printed are set for one print job. In this case, the remaining one number of copies is determined from a difference between the set total number of copies to be printed and the two numbers of copies.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-262316, Nov. 30, 2012 filed, and Japanese Patent Application No. 2013-214695, Oct. 15, 2013 filed, which are hereby incorporated by reference herein in their entirety.

What is claimed is:

1. An image forming apparatus, comprising:

an image forming section configured to form an image on a sheet based on an image forming job;

a conveying mechanism configured to convey the sheet to a post-processing apparatus configured to perform a binding process for the sheet on which the image is formed;

an operation section configured to receive an input of information on a number of copies to be processed in a case where image formation for a plurality of copies are performed in one image forming job, the information serving to identify a first number of copies being a number of the sheet bundles to be subjected to a first binding process by using a binding fastener in the post-processing apparatus and a second number of copies being a number of the sheet bundles to be subjected to a second binding process different from the first binding process without use of the binding fastener; and a control section configured to cause the post-processing apparatus to perform the first binding process for the first number of copies and the second binding process for the second number of copies based on the information on the number of copies to be processed which is received by the operation section, wherein the operation section receives an input relating to a ratio between the first number of copies and the second number of copies and an input of a total number of copies to be printed within the one image forming job.

2. An image forming apparatus according to claim 1, wherein:

the first binding process includes a binding process performed by using a staple; and the second binding process includes a binding process performed by nipping and pressurizing a plurality of sheets of the sheets between upper teeth and lower teeth, which are engaged with each other, without use of the staple.

3. An image forming apparatus comprising:

an image forming section configured to form an image on a sheet based on an image forming job;

a conveying mechanism configured to convey the sheet to a post-processing apparatus configured to perform a binding process for the sheet on which the image is formed;

an operation section configured to receive an input of information on a number of copies to be processed in a case where image formation for a plurality of copies are performed in one image forming job, the information serving to identify a first number of copies being a number of the sheet bundles to be subjected to a first binding process by using a binding fastener in the post-processing apparatus and a second number of copies being a number of the sheet bundles to be subjected to a second binding process different from the first binding process without use of the binding fastener; and a control section configured to cause the post-processing apparatus to perform the first binding process for the first number of copies and the second binding process for the second number of copies based on the information on the number of copies to be processed which is received by the operation section, wherein the operation section receives an input of any one of: a pair of the first number of copies and the second number of copies; a pair of one number of copies selected from the group consisting of the first number of copies and the second number of copies, and a coefficient for deriving another number of copies from the one number of copies; a pair of a total number of copies of the sheets to be subjected to the binding process and one of the first number of copies and the second number of copies; and a pair of the total number of copies and a coefficient for deriving the first number of copies and the second number of copies from the total number of copies, as the information on the number of copies to be processed, to thereby identify the first number of copies and the second number of copies comprised in the one image forming job.

4. An image forming apparatus, comprising:

an image forming section configured to form an image on a sheet based on an image forming job;

a first binding section configured to perform a first binding process for the sheets on which the image is formed by the image forming section by using a binding fastener;

a second binding section configured to perform a second binding process different from the first binding process for the sheets on which the image is formed by the image forming section without use of the binding fastener;

an operation section configured to receive an input of information on a number of copies to be processed in a case where image formation for a plurality of copies are performed in one image forming job, the information serving to identify a first number of copies being a number of stacks of the sheets to be subjected to the first binding process by using the binding fastener in a post-processing apparatus and a second number of copies being a number of stacks of the sheets to be subjected to the second binding process different from the first binding process without use of the binding fastener; and a control section configured to cause the first binding section to perform the first binding process for the first number of copies and the second binding section to perform the second binding process for the second number of copies based on the information on the number of copies to be processed which is received by the operation section, wherein the operation section receives an input relating to a ratio between the first number of copies and the second number of copies and in input of a total number of copies to be printed within the one image forming job.

5. An image forming apparatus according to claim 4, wherein:

the first binding process includes a binding process performed by using a staple; and the second binding process includes a binding process performed by nipping and pressurizing a plurality of sheets of the sheets between upper teeth and lower teeth, which are engaged with each other, without use of the staple.

6. An image forming apparatus, comprising:

an image forming section configured to form an image on a sheet based on an image forming job;

a first binding section configured to perform a first binding process for the sheets on which the image is formed by the image forming section by using a binding fastener;

a second binding section configured to perform a second binding process different from the first binding process for the sheets on which the image is formed by the image forming section without use of the binding fastener;

an operation section configured to receive an input of information on a number of copies to be processed in a case where image formation for a plurality of copies are performed in one image forming job, the information serving to identify a first number of copies being a number of stacks of the sheets to be subjected to the first binding process by using the binding fastener in a post-processing apparatus and a second number of copies being a number of stacks of the sheets to be subjected to the second binding process different from the first binding process without use of the binding fastener; and a control section configured to cause the first binding section to perform the first binding process for the first number of copies and the second binding section to perform the second binding process for the second number of copies based on the information on the number of copies to be processed which is received by the operation section, wherein the operation section receives an input of any one of: a pair of the first number of copies and the second number of copies; a pair of one number of copies selected from the group consisting of the first number of copies and the second number of copies, and a coefficient for deriving another number of copies from the one number of copies; a pair of a total number of copies of the sheets to be subjected to the binding process and one of the first number of copies and the second number of copies; and a pair of the total number of copies and a coefficient for deriving the first number of copies and the second number of copies from the total number of copies, as the information on the number of copies to be processed, to thereby identify the first number of copies and the second number of copies comprised in the one image forming job.

* * * * *